US005830042A

United States Patent [19]

Anderson

[11] Patent Number: 5,830,042

[45] Date of Patent: Nov. 3, 1998

[54] SURFACE ABRASIVE TREATMENT OF SMALL OBJECTS

[75] Inventor: Alexander Stephen Anderson, Shirley, Great Britain

[73] Assignee: Koolmill Systems Limited, Shirley, Great Britain

[21] Appl. No.: 737,074

[22] PCT Filed: Apr. 12, 1995

[86] PCT No.: PCT/GB95/00859

§ 371 Date: Oct. 21, 1996

§ 102(e) Date: Oct. 21, 1996

[87] PCT Pub. No.: WO95/29010

PCT Pub. Date: Nov. 2, 1995

[30] Foreign Application Priority Data

Apr. 22, 1994 [GB] United Kingdom ..... 9408063

[51] Int. Cl.[6] ..... B02B 5/00; B24B 1/00

[52] U.S. Cl. ..... 451/59; 241/7; 241/9; 451/299; 451/182

[58] Field of Search ..... 241/6, 7, 9; 451/178, 451/59, 182, 299, 231, 331, 451

[56] References Cited

U.S. PATENT DOCUMENTS

| | | | |
|---|---|---|---|
| 208,642 | 10/1878 | Shanton | 241/9 X |
| 234,122 | 11/1880 | Fredenhagen | 241/7 |
| 258,552 | 5/1882 | Brown | 241/7 X |
| 581,908 | 5/1897 | Gent et al. | 241/9 |
| 3,517,889 | 6/1970 | Farmer | 241/9 |
| 3,964,715 | 6/1976 | Burgess, Jr. | 241/7 |
| 4,196,224 | 4/1980 | Falk | 241/7 X |
| 5,377,916 | 1/1995 | Anderson | 241/7 |

FOREIGN PATENT DOCUMENTS

| | | | |
|---|---|---|---|
| 4-281853 | 10/1992 | Japan | 241/7 |

*Primary Examiner*—Timothy V. Eley

*Attorney, Agent, or Firm*—Caesar, Rivise, Bernstein, Cohen & Pokotilow, Ltd.

[57] ABSTRACT

Rice or like small objects is milled in a machine comprising a rotating vertical drum having an endless abrasive belt. Chambers are spaced about the drum so that the belt acts as a floor to the chambers with a slight gap in between. The objects are passed vertically downwards and abraded by the belt, surface material removed from the objects passing through the gap and falls out via a subsidiary outlet alongside the main outlet of each chamber.

6 Claims, 1 Drawing Sheet

SURFACE ABRASIVE TREATMENT OF SMALL OBJECTS

This invention relates to apparatus and method for use in the surface abrasive treatment of small objects, for example, seeds, including cereals, legumes, nuts and the like; cleaning aggregate and objects of wood, plastics, mineral or metal.

Apparatus for this general purpose is known see, e.g. GB-A-2101871 where the apparatus is used to polish rice. Usually such apparatus comprises a vertically disposed chamber having a top inlet and a bottom outlet, the chamber containing an abrasive stone with an annular clearance in between the stone and the wall of the chamber. A portion of the wall is perforated. In use, small objects to be abraded are fed into the inlet and urged through the chamber, the stone being rotated to abrade material off the surface of the small objects. The process is not efficient and much energy is required to generate the pressure to abrade off the surface material. This generates heat which can damage the small objects, especially rice. It is necessary to force air into the chamber to drive the abraded off surface material out through the perforated wall portion (which has the advantage of cooling the small objects).

OBJECTS OF THE INVENTION

It is one object of the invention to provide apparatus for the purpose specified in which there is little or no need to apply forced air to separate the material abraded from the small objects. This object of the invention is achieved by substituting a moving abrasive belt for the stone, and locating one or more chambers about the belt, each having at one side an inlet for the abraded material which exits from the apparatus via a second outlet generally alongside the main outlet through which the abraded small objects exit from the apparatus.

According to the invention in one aspect there is provided apparatus for use in the surface abrasion treatment of small objects to remove surface material therefrom, the apparatus comprising: a drum member having an abrasive surface, and means for rotating the drum about a substantially vertical axis; at least one treatment chamber adjacent the periphery of the drum, each chamber comprising an outer surface and side walls and having an inlet adjacent the top of the drum and a main outlet adjacent the bottom of the drum; the outer surface being opposite the abrasive surface of the drum; and at least one side wall spaced from the abrasive surface so that a clearance is present therebetween; a subsidiary outlet being present adjacent the main outlet; whereby, in use, small objects supplied to the inlet of the chamber(s) are treated by passage through the chambers by the abrasive surface of the rotating drum to remove surface material therefrom and the abraded small objects leave via the main outlet and the surface material leaves via the subsidiary outlet.

BRIEF DESCRIPTION OF THE INVENTION

According to the invention in another aspect there is provided a method of abrading small objects to remove surface material therefrom, the method comprising passing the small objects via an inlet at the top of a chamber towards the bottom thereof, the chamber having a floor defined by a rotating drum having an abrasive surface, the chamber having an outer surface opposite the floor, the chamber having side walls at least one of which is spaced from the floor so that a small clearance is present therefrom, the chamber having a main outlet and a subsidiary outlet, the inlet being located above the outlets, and allowing the abraded material to leave via the subsidiary outlet and the abraded objects to leave the main outlet.

We have proposed in a number of patent publications apparatus for the purpose specified and which comprises in combination a chamber; means for providing an abrasive moving bottom which passes under a transverse wall of the chamber; an inlet for objects to be abraded; and an outlet for abraded objects, the apparatus being arranged so that in use objects recirculate in the chamber and material removed from the objects passes under the transverse wall. The chamber has a top, opposed to the bottom, this top being sufficiently close to the bottom that, in use pressure is exerted on the recirculating objects to press the lowermost objects against the bottom. See for example, GB-A-2249043, GB-A-2225522 and WO 91/12078. In the apparatus in which the chamber has a moving bottom an endless belt having an abrasive surface moves over a plate. The alignment of the belt with the generally flat plate is not always accurate, leading to an increase in power consumption and a risk that there will be incomplete separation of the abraded material from the abraded small objects. Such disadvantages are avoided in this invention.

In a preferred embodiment of the present invention, an auger is associated with each chamber to supply the objects into the respective chamber, either from the top or the bottom. Pressure may be generated by use of the auger and that pressure is generated over a large area in the chamber thereby improving the efficiency of the apparatus. The apparatus may include means for restricting the flow of abraded objects from the main outlet in which case the pressure generated depends on a balance between the effect of the auger (e.g. its speed of rotation) and the degree of restriction of the outlet.

The auger may be situated only in the inlet in which case it acts to feed the small objects through the inlet into the chamber. The outlet is of reduced size compared to the cross-section of the chamber, so as to restrict the flow of objects leaving the chamber, such that a significant pressure is generated in the chamber, the pressure being contained by the top of the chamber. The pressure urges the objects against the abrasive surface of the rotating drum.

Our evaluations have established that the diameter of the main outlet is a first control over the extent of removal of the surface material. The local milling pressure will be dependent on inter alia the geometry of the chamber, the speed of travel of the abrasive surface and its abrasiveness, and these parameters may be used as a second level of control. The small objects may be treated in the apparatus more than once.

The drum preferably has a covering or coating of abrasive material or a separate belt or sleeve.

Means may be present for drawing a vacuum outside the chamber to remove surface material, abraded from the objects from the subsidiary outlet.

One embodiment of the invention will now be described, by way of example only, with reference to the accompanying diagrammatic drawings, in which:

DETAILED DESCRIPTION OF THE INVENTION

Figure 1:
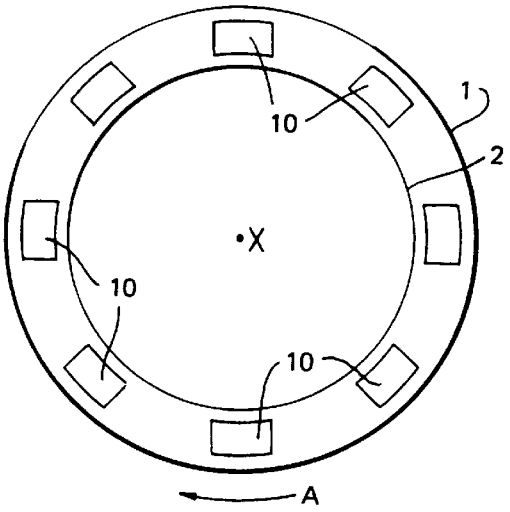
FIG. 1 is a top plan view of apparatus of the invention.
Figure 3:
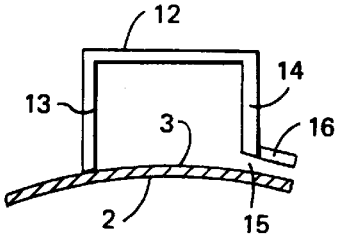
FIG. 3 is a section taken on line III—III on FIG. 2.

The apparatus comprises a cylindrical housing 1 containing a drum 2 having about its sidewall an abrasive sheet or belt 3. The drum 2 is arranged to rotate about a vertical axis X—X powered by a motor, not shown. A number of elongate treatment chambers 10 are spaced about the drum 2 each extending generally parallel to the axis X—X. Each chamber 10 has an inlet 11 in the roof of the housing 1, an outer wall 12, and two sidewalls 13, 14. The sidewall 13 is relatively close to the belt 3 on the drum 2 and the sidewall 14 is spaced a short distance therefrom to define a clearance 15. An optional extension wall 16 is present adjacent the clearance 15 to form a collection area between the milling chambers 10. A main outlet 17 is present at the lower end of the chamber 10 and a generally parallel subsidiary outlet 18 is present below the extension wall 16.

The sheet or belt 3 comprises a coating of sand or grit on a backing of paper or plastics, the particles being held in place by a resin or like bond. The clearance 15 is about 0.25 mm.

In use, the drum 2 is rotated in the direction of the arrow A shown. Small objects to be abraded are loaded into a hopper 20 and fed via pipes 21 to the inlet 11 of one or more chambers 10. By way of example, the small objects may be grains of rice from which the outer layers, part or all of the husk or hull and bran layers, are to be removed. As the drum rotates it abrades the particles adjacent to its surface to abrade off some of the surface material. The particles pass from the inlet 11 to the outlet 17 of each chamber, the abraded material being urged under the side-wall 14 and is directed by the extension wall 16 to the outlet 18, preferably under the force of gravity. The process is efficient, consumes little power and the small objects are not heated. In one example, drum 2 is run to produce a surface speed of about 10 metres/sec. Rice grains are fed via the inlet 11 of the or each chamber 10. The grains are fed through the chamber 10 at a rate to generate pressure as described above and to urge the objects against the abrasive surface 3 of the drum 2 as the objects pass through the chambers.

The grains recirculate under the action of the abrasive surface of the rotating drum 2 so that they contact abrasive surface 3 repeatedly and an outer layer of the objects is removed. The material removed, e.g. bran and/or husk passes under the wall 14 through the clearance 15 and the outlet 18 and the whitened grains leave the chamber via outlet 17. Grains are thus collected separately from the bran and/or husk and pass to collection bags.

The invention is not limited to the embodiment shown. The wall 16 may be flexible or rigid. A vacuum may be drawn. An auger may be present in the inlet. The wall 12 of the chamber may be flat or curved. In the embodiment shown the chambers are arranged all about the rotary drum. The invention also includes apparatus in which some chambers are disposed in an arc of the drum and means are provided on the opposite side of the drum to tension and track the belt.

I claim:

1. A method of abrading small objects to remove surface material therefrom, the method comprising treating the small objects in an apparatus comprising:

A) a drum having a separate sheet or belt presenting an abrasive surface;

B) means for rotating the drum in a predetermined direction of rotation about a substantially vertical axis;

C) a plurality of treatment chambers spaced circumferentially about the drum adjacent the periphery of the drum, each chamber having a chamber inlet adjacent the top of the drum and a main outlet located adjacent the bottom of the drum for discharging abraded small objects, each chamber having first and second substantially vertical walls extending towards the abrasive surface and separated in the circumferential direction by an opening at a radially inner side of the chamber, the second substantially vertical wall being displaced from the first substantially vertical wall in the direction of rotation, and the second substantially vertical wall having a radially inner edge facing the abrasive surface and separated therefrom by a gap for discharging surface material abraded from the small objects; said method comprising the steps of introducing the small objects into said chamber inlet and then allowing the abraded objects to discharge via said main outlet with the surface material having been abraded from the small objects and the further step of permitting the surface material abraded from the small objects to discharge via said gap.

2. A method according to claim 1, wherein the clearance between said edge and abrasive surface is about 0.25 mm.

3. A method according to claim 1, including allowing the abraded material to fall through the chamber under the force of gravity.

4. Apparatus for use in the surface abrasion treatment of small objects to remove surface material therefrom, the apparatus comprising:

a) a drum having a separate sheet or belt presenting an abrasive surface;

b) means for rotating the drum in a predetermined direction of rotation about a substantially vertical axis;

c) a plurality of treatment chambers spaced circumferentially about the drum adjacent the periphery of the drum, each chamber having an inlet adjacent the top of the drum and a main outlet located adjacent the bottom of the drum for discharging abraded small objects, each chamber having first and second substantially vertical walls extending towards the abrasive surface and separated in the circumferential direction by an opening at a radially inner side of the chamber, the second substantially vertical wall being displaced from the first substantially vertical wall in the direction of rotation, and the second substantially vertical wall having a radially inner edge facing the abrasive surface and separated therefrom by a gap for discharging surface material abraded from the small objects.

5. Apparatus as claimed in claim 4, further comprising auger means for feeding said small objects to said inlet.

6. Apparatus according to claim 4, wherein the clearance between said edge and abrasive surface is about 0.25 mm.

* * * * *

UNITED STATES PATENT AND TRADEMARK OFFICE

CERTIFICATE OF CORRECTION

Patent No. : 5,830,042

Dated : November 3, 1998

Inventor(s) : Alexander Stephen Anderson

It is certified that error appears in the above-identified patent and that said Letters Patent are hereby corrected as shown below:

Replace sheet 1 of drawings with attached new sheet 1.

Figure 2:
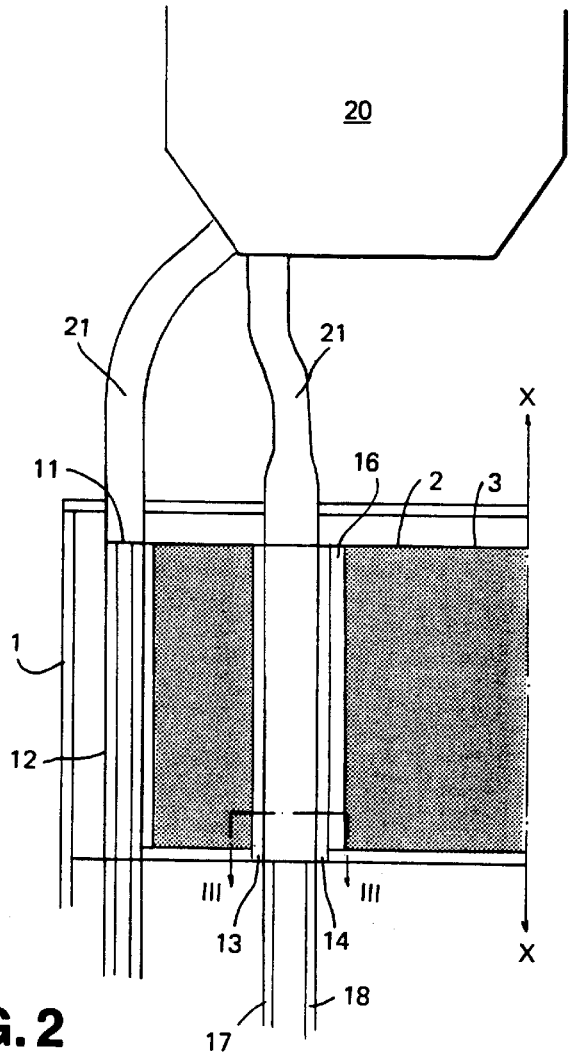
FIG. 2 is a side elevation showing two chambers of the apparatus of FIG. 1.
Figure 1:
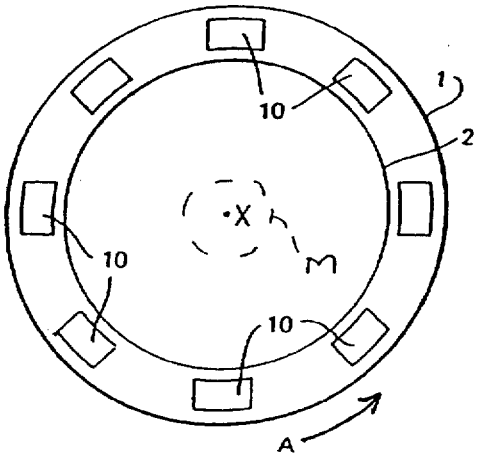
Figure 3:
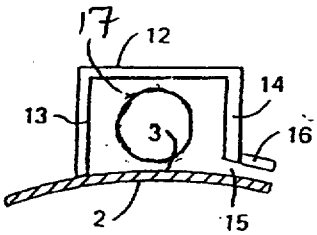
Figure 2:
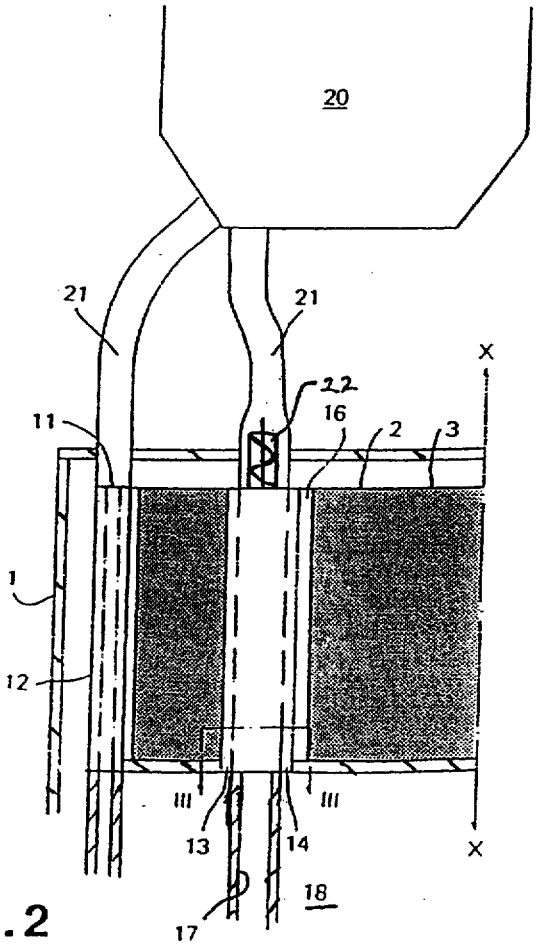
Figure 1:
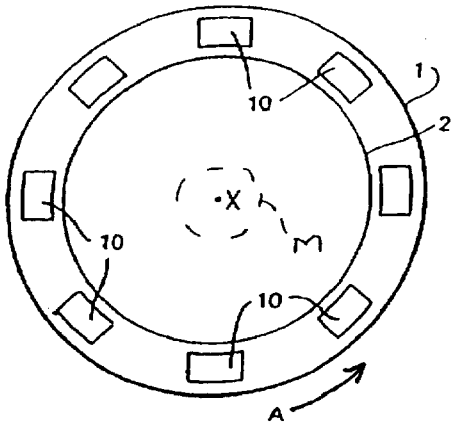
Figure 3:
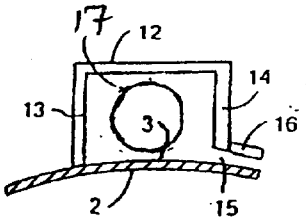
Figure 2:
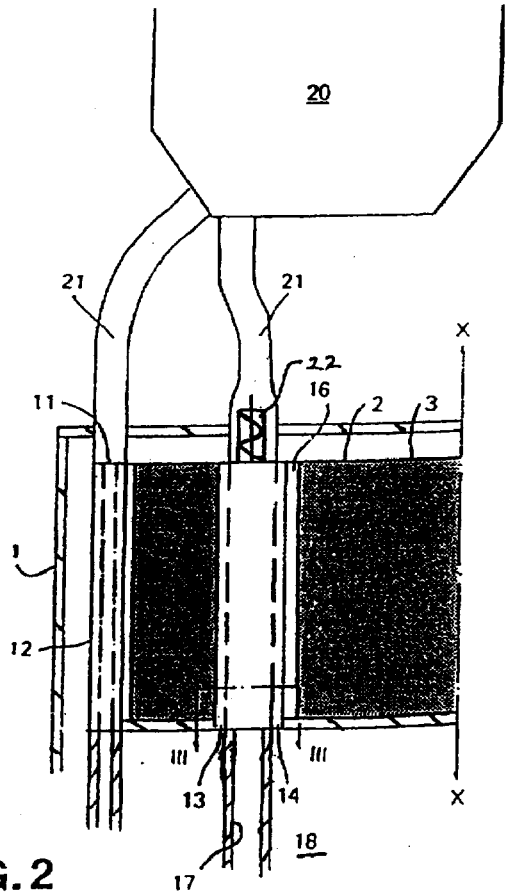

On the title page, Fig. 2 should be replaced with corrected Fig. 2 shown in new sheet of drawing.

Signed and Sealed this

Twenty-second Day of August, 2000

*Attest:*

Q. TODD DICKINSON

*Attesting Officer*

*Director of Patents and Trademarks*

United States Patent [19]

Anderson

[11] Patent Number: 5,830,042

[45] Date of Patent: Nov. 3, 1998

[54] SURFACE ABRASIVE TREATMENT OF SMALL OBJECTS

[75] Inventor: Alexander Stephen Anderson, Shirley, Great Britain

[73] Assignee: Koolmill Systems Limited, Shirley, Great Britain

[21] Appl. No.: 737,074

[22] PCT Filed: Apr. 12, 1995

[86] PCT No.: PCT/GB95/00859

§ 371 Date: Oct. 21, 1996

§ 102(e) Date: Oct. 21, 1996

[87] PCT Pub. No.: WO95/29010

PCT Pub. Date: Nov. 2, 1995

[30] Foreign Application Priority Data

Apr. 22, 1994 [GB] United Kingdom ..... 9408063

[51] Int. Cl.[6] ..... B02B 5/00; B24B 1/00

[52] U.S. Cl. ..... 451/59; 241/7; 241/9; 451/299; 451/182

[58] Field of Search ..... 241/6, 7, 9; 451/178, 451/59, 182, 299, 231, 331, 451

[56] References Cited

U.S. PATENT DOCUMENTS

| | | | |
|---|---|---|---|
| 208,642 | 10/1878 | Shanton | 241/9 X |
| 234,122 | 11/1880 | Fredenhagen | 241/7 |
| 258,552 | 5/1882 | Brown | 241/7 X |
| 581,908 | 5/1897 | Gent et al. | 241/9 |
| 3,517,889 | 6/1970 | Farmer | 241/9 |
| 3,964,715 | 6/1976 | Burgess, Jr. | 241/7 |
| 4,196,224 | 4/1980 | Falk | 241/7 X |
| 5,377,916 | 1/1995 | Anderson | 241/7 |

FOREIGN PATENT DOCUMENTS

| | | | |
|---|---|---|---|
| 4-281853 | 10/1992 | Japan | 241/7 |

*Primary Examiner*—Timothy V. Eley

*Attorney, Agent, or Firm*—Caesar, Rivise, Bernstein, Cohen & Pokotilow, Ltd.

[57] ABSTRACT

Rice or like small objects is milled in a machine comprising a rotating vertical drum having an endless abrasive belt. Chambers are spaced about the drum so that the belt acts as a floor to the chambers with a slight gap in between. The objects are passed vertically downwards and abraded by the belt, surface material removed from the objects passing through the gap and falls out via a subsidiary outlet alongside the main outlet of each chamber.

6 Claims, 1 Drawing Sheet

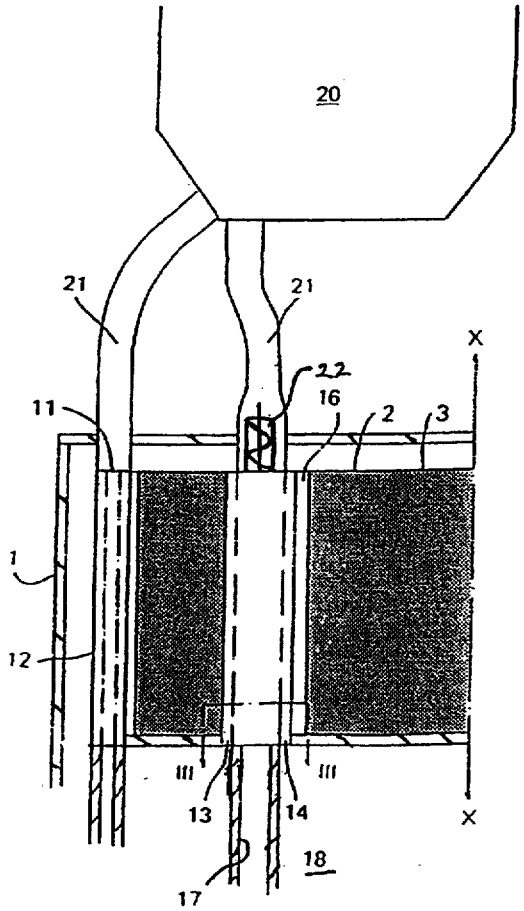

UNITED STATES PATENT AND TRADEMARK OFFICE

CERTIFICATE OF CORRECTION

PATENT NO. : 5,830,042
DATED : November 3, 1998
INVENTOR(S) : Alexander Stephen Anderson It is certified that error appears in the above-identified patent and that said Letters Patent is hereby corrected as shown below:

Title page,
Fig. 2 should be replaced with corrected Fig. 2 shown in new sheet of drawing.

Drawings,
Replace sheet 1 of drawings with attached new sheet 1.

This certificates supersedes Certificate of Correction issued August 22, 2000.

Signed and Sealed this

First Day of April, 2003

JAMES E. ROGAN
*Director of the United States Patent and Trademark Office*

United States Patent [19]

Anderson

[11] Patent Number: 5,830,042

[45] Date of Patent: Nov. 3, 1998

[54] SURFACE ABRASIVE TREATMENT OF SMALL OBJECTS

[75] Inventor: Alexander Stephen Anderson, Shirley, Great Britain

[73] Assignee: Koolmill Systems Limited, Shirley, Great Britain

[21] Appl. No.: 737,074

[22] PCT Filed: Apr. 12, 1995

[86] PCT No.: PCT/GB95/00859

§ 371 Date: Oct. 21, 1996

§ 102(e) Date: Oct. 21, 1996

[87] PCT Pub. No.: WO95/29010

PCT Pub. Date: Nov. 2, 1995

[30] Foreign Application Priority Data

Apr. 22, 1994 [GB] United Kingdom ..... 9408063

[51] Int. Cl.[6] ..... B02B 5/00; B24B 1/00

[52] U.S. Cl. ..... 451/59; 241/7; 241/9; 451/299; 451/182

[58] Field of Search ..... 241/6, 7, 9; 451/178, 451/59, 182, 299, 231, 331, 451

[56] References Cited

U.S. PATENT DOCUMENTS

| | | | |
|---|---|---|---|
| 208,642 | 10/1878 | Shanton | 241/9 X |
| 234,122 | 11/1880 | Fredenhagen | 241/7 |
| 258,552 | 5/1882 | Brown | 241/7 X |
| 581,908 | 5/1897 | Geat et al. | 241/9 |
| 3,517,889 | 6/1970 | Farmer | 241/9 |
| 3,964,715 | 6/1976 | Burgess, Jr. | 241/7 |
| 4,196,224 | 4/1980 | Falk | 241/7 X |
| 5,377,916 | 1/1995 | Anderson | 241/7 |

FOREIGN PATENT DOCUMENTS

| | | | |
|---|---|---|---|
| 4-281853 | 10/1992 | Japan | 241/7 |

*Primary Examiner*—Timothy V. Eley

*Attorney, Agent, or Firm*—Caesar, Rivise, Bernstein, Cohen & Pokotilow, Ltd.

[57] ABSTRACT

Rice or like small objects is milled in a machine comprising a rotating vertical drum having an endless abrasive belt. Chambers are spaced about the drum so that the belt acts as a floor to the chambers with a slight gap in between. The objects are passed vertically downwards and abraded by the belt, surface material removed from the objects passing through the gap and falls out via a subsidiary outlet alongside the main outlet of each chamber.

6 Claims, 1 Drawing Sheet

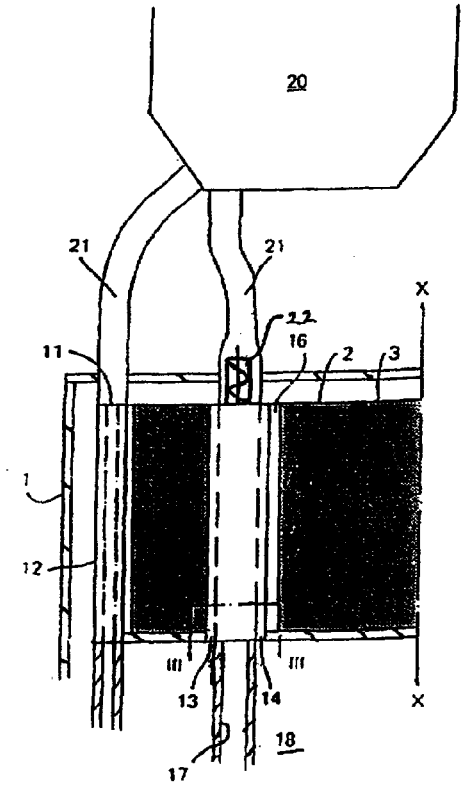

U.S. Patent Nov. 3, 1998 5,830,042